US005682909A

United States Patent [19]

Yasuda

[11] Patent Number: 5,682,909

[45] Date of Patent: *Nov. 4, 1997

[54] HAIR CLIP

[75] Inventor: Masahiro Yasuda, Osaka, Japan

[73] Assignee: Kabushiki Kaisha Yasuda Corporation, Osaka, Japan

[ * ] Notice: The term of this patent shall not extend beyond the expiration date of Pat. No. 5,445,170.

[21] Appl. No.: 517,165

[22] Filed: Aug. 21, 1995

Related U.S. Application Data

[63] Continuation-in-part of Ser. No. 106,385, Aug. 13, 1993, Pat. No. 5,445,170.

[30] Foreign Application Priority Data

Aug. 19, 1992 [JP] Japan ..... 4-220045

[51] Int. Cl.[6] ..... A45D 8/28

[52] U.S. Cl. ..... 132/279

[58] Field of Search ..... 132/275, 278, 132/279

[56] References Cited

U.S. PATENT DOCUMENTS

| | | | |
|---|---|---|---|
| 2,921,589 | 1/1960 | Blomme | 132/279 |
| 3,805,813 | 4/1974 | Laughton . | |
| 4,919,155 | 4/1990 | Yasuda | 132/278 |
| 5,109,878 | 5/1992 | Kno-Hua | 132/279 |

FOREIGN PATENT DOCUMENTS

| | | | |
|---|---|---|---|
| 2170550 | 9/1973 | France . | |
| 2635653 | 3/1990 | France . | |
| 3541608 | 11/1986 | Germany | 132/278 |
| 39 07716 | 9/1989 | Germany . | |
| 45-3321 | 2/1970 | Japan . | |
| 50-47698 | 5/1975 | Japan . | |
| 50-154195 | 12/1975 | Japan . | |
| 57-55403 | 3/1982 | Japan . | |
| 61-174504 | 10/1986 | Japan . | |
| 1-76702 | 5/1989 | Japan . | |

*Primary Examiner*—Todd E. Manahan

*Attorney, Agent, or Firm*—Tilton, Fallon, Lungmus & Chestnut

[57] ABSTRACT

A hair clip includes a base plate (1) secured to an ornamental cover and a pair of hooking arms (13) extending from the base plate, in which each arm has an extension protruding from an outer edge at the base portion of the arm. The extensions (13*c*) come into a sliding contact with an engaging part (4*b*) of a hair retainer (4) when it is moved towards its closed position. A shackling member (15) is provided for holding the hooking arms (13) at their overlapping position even after the arms have been unlatched. The hair clip further has a restoring member (14) which urges the shackling member (15) to return to its another position where the arms are freed, when the hair retainer (4) is opened such that the engaging part (4*b*) can no longer be latched by the hooking arms (13). Such a mechanism makes easier the unlatching of the hair clip, which is simple in structure and easy to manufacture and assemble.

13 Claims, 11 Drawing Sheets

HAIR CLIP

This application is a continuation-in-part of application Ser. No. 08/106,385 filed Aug. 13, 1993, now U.S. Pat. No. 5,445,170.

BACKGROUND OF THE INVENTION

1. Technical Field of the Invention

The present invention relates to a hair clip and more particularly to an ornamental hair clip for retaining hair by and between two metal sheets by a spring force.

2. Prior Art

There are many kinds of hair clips known in the art, and disclosed for example in Japanese Utility Model Publication (unexamined) Nos. 45-3321, 50-47698, 50-154195, 57-55403, 61-174504 and 1-76702. Those prior art hair clips generally comprise a base plate fixed to an ornamental cover, a downwardly curved and band-shaped spring board whose both ends are fixed to the base plate, and a band-shaped retainer operably disposed beneath the spring board. The retainer has a fixed end pivoted to a pair of brackets protruding from one end of the base plate, and also has a movable end formed with an engaging part which is releasably latched to a pair of hooks provided at the other end of the base plate.

These prior art hair clips retain hair by and between the spring board and the retainer, with the engaging part thereof being held in place by the hooks. When the hair is to be released form the clip, the movable end of the retainer is unlatched from the base plate by pressing ledges toward each other, which ledges are integral with the hooks and protrude from the base plate.

Thus, the unlatching operation of those conventional hair clips is done by gripping the pair of ledges behind the ornamental cover. However, the insertion of the user's fingers underneath the ornamental cover is not easy, because the cover is in close contact with her or his hairs. Especially when the ornamental cover is relatively large, the hair release becomes more difficult because of a large spacing between the periphery of the cover and the ledges.

In order to resolve this problem, the present applicant has proposed a novel type of hair clip as disclosed in the U.S. Pat. No. 4,919,155. This hair clip includes a release mechanism constructed such that the retainer only need be pressed toward the base plate having the hooks or hooking arms. The pressed retainer causes the hooking arms to become so close to each other as to unlatch the retainer.

In detail, the hair clip according to my preceding patent includes a base plate attached to an ornamental cover and further includes a pair of brackets at one end and a pair of ledges at the other end; a hair retainer rotatably connected to the brackets at its fixed end, the hair retainer having an engaging portion at its other or movable end, a pair of hooking arms projecting inward from the inside of the ledges, each arm including a leg portion capable of overlapping the leg portion of the other arm, the engaging portion including a central dented part and a pair of arched bridge parts at opposite sides of the dented part, and a ring placed between the central dented part and the arched bridge parts, the ring having a central opening for allowing the leg portions of the arms to fit in when they overlap with each other for unlatching.

In use, this hair clip having the ring as a releaser may be removed from the user's hair by pressing at first the movable end of hair retainer toward her or his head and thereby rendering free the movable end.

When releasing the hair clip, the user need no longer insert her or his fingers beneath the ornamental cover, contrary to the various prior art hair retainers, so as to operate the ledges. Instead of doing so, she or he who wants to remove the hair clip may simply press an end of the ornamental cover. Thus, it is a remarkable advantage that the hair clip can be removed very easily even if its ornamental cover is considerably large.

The hair clip according to my preceding patent has however proved somewhat problematic from the following points of view.

The ring serving as the releaser has the central opening which, as mentioned above, is forced to fit on and receive therein the overlapped pair of hooking arms. Therefore, the ring must be of a strength sufficient to withstand a strong outward and radial force which the forcibly fitted arms will impart to the ring.

Since the arms are strongly urged against the inner peripheral wall of the central opening, the ring must be highly resistant to abrasion. Further, the ring must not cause such an intensive friction that will hinder the arms from smoothly fitting in the central opening. Thus, the ring has to be made of a stiff material meeting all of the mentioned requirements, with the inner periphery of its central opening being nevertheless machined to have a less frictional finished surface, thereby raising the manufacture cost of such a ring.

It is noted that the ring, which is disposed between the central dented part and the opposite bridge parts both formed at the movable end of the hair retainer, is capable of moving up and down. Therefore a means for protecting the ring from slipping off is necessary, and this protecting means may include a pair of parallel guide posts extending from opposite longitudinal ends of the dented part. Correspondingly, slots are formed on the periphery of the ring so as to engage the respective guide posts.

Such a protecting means complicates the structure of the ring and hair retainer. The manufacture thereof, and in particular, the work for attaching the ring to the retainer, becomes considerably intricate, thereby raising production costs.

The outer hooking tip ends of the pair of overlapping arms are forced to rub the inner periphery of the central opening of the ring whenever the retainer is released. Thus, the tip ends are likely to be worn out so soon that the hair clip as a whole becomes less durable.

OBJECTS AND SUMMARY OF THE INVENTION

An object of the present invention which was made to resolve the aforementioned problems is therefore to provide a hair clip which is readily releasable from the hair of a user, simple in structure, easy to manufacture and assemble, and is improved in durability.

According to the illustrated embodiment of the invention, the hair clip includes an elongated base plate having first and second ends and at the first end a pair of hooking arms capable of overlapping with one another, an elongated hair retainer having first and second ends with the second end rotatably connected to the second end of the base plate, the hair retainer further having at the second end thereof an engaging part releasably latched by the pair of the hooking arms. A spring board is interposed between the base plate and the hair retainer and shaped so as to urge the hair retainer toward its open state as long as the engaging part is latched by the hooking arms. There is included a releasing means for releasing the hair retainer from the base plate which includes clampable members each protruding outwardly from a base portion of the hooking arms so as to come into a direct or indirect contact with the engaging part of the hair retainer. The clampable members are shaped so that when the first end of the base plate is pressed toward the first end of the hair retainer which is in its latched position, the hooking arms are caused to overlap with each other to take a releasable position. Also included is a shackling member shaped to hold the hooking arms in their overlapping state even after they have taken the releasable position. Further included is a restoring member shaped to urge the shackling member toward its free position for releasing the hooking arms as the hair retainer is rotated away from the base plate toward its open state in which the engaging part is no longer latched by the hooking arms.

Other objects and advantages of the present invention will become apparent from the description of the preferred embodiments, which may be modified in any manner without departing from the scope and spirit of the invention.

BRIEF DESCRIPTION OF THE DRAWINGS

FIGS. 8A to 9C are cross-sectional views which correspond to FIGS. 4A to 4C but of the second embodiment;

DETAILED DESCRIPTION

The present invention will now be described in more detail referring to the first embodiment shown in FIGS. 1 to 5C.

First Embodiment

The words "up" or the like are used herein for convenient description of the portions nearer the top edge of the paper, with the words "down" or the like meaning the portions nearer bottom edge.

Figure 1:
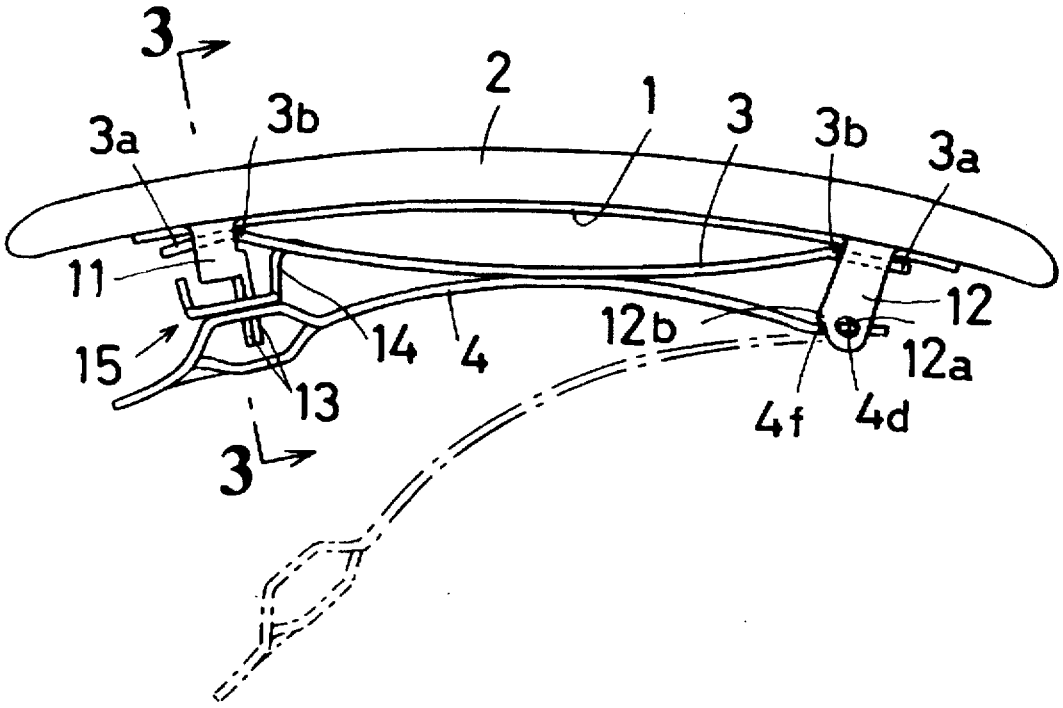
FIG. 1 is a side elevation showing in closed state a hair clip provided in a first embodiment of the invention.

A hair clip in FIG. 1 includes a base plate 1, an ornamental cover 2 attached to the upper surface of the base plate, a spring board 3, a hair retainer 4 and a releasing means.

Base Plate

The base plate 1 for securing the ornamental cover 2 is made of metal.

Figure 2:
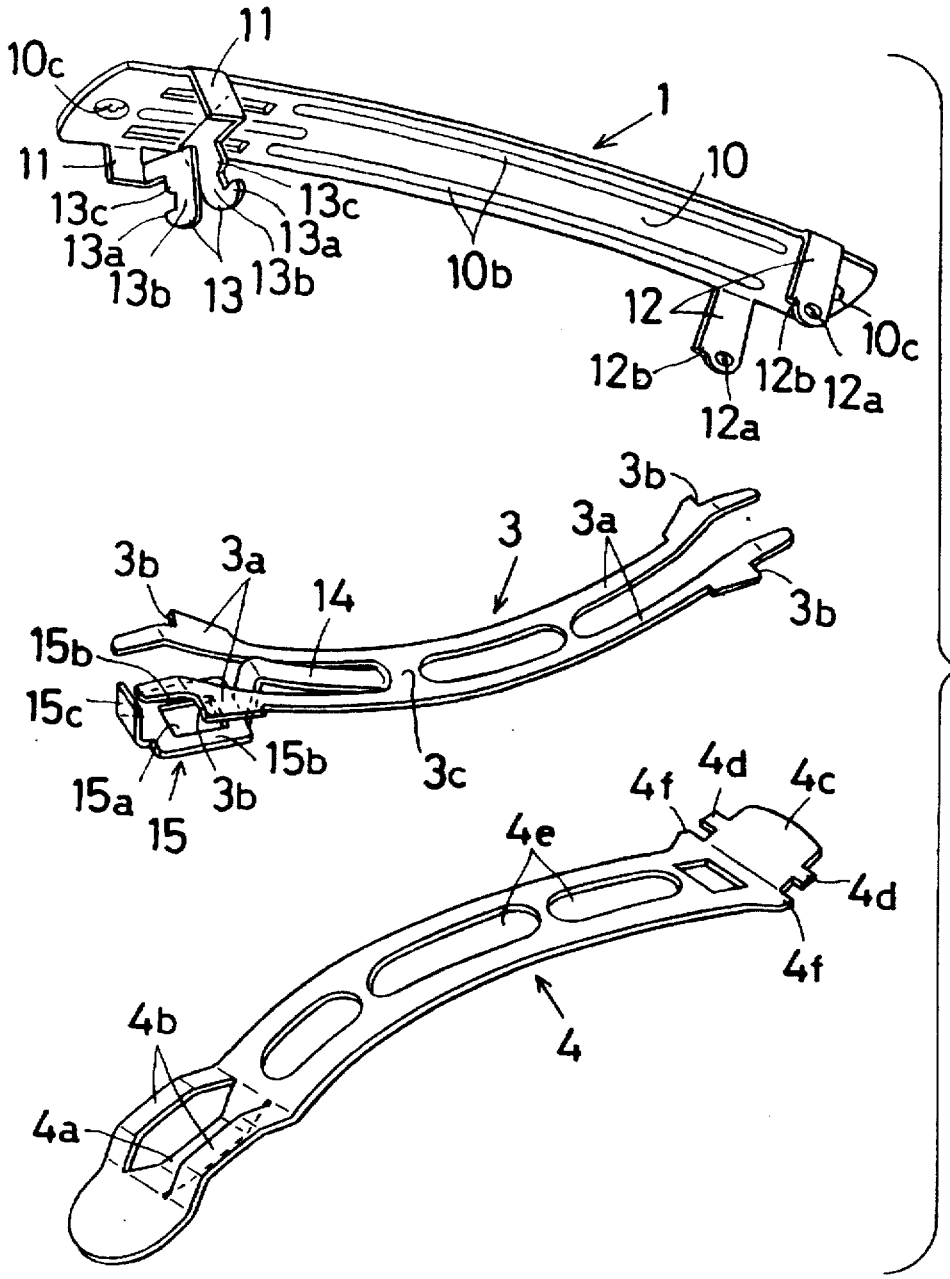
FIG. 2 is an exploded perspective view of a base plate, a spring board and a hair retainer which constitute the hair clip in the embodiment of FIG. 1, the base plate being shown without the ornamental cover of FIG. 1.

As shown in FIG. 2, the base plate 1 is made of a band-shaped sheet portion 10 which is slightly curved upward, a pair of ledges 11 facing one another and downwardly protruding from opposite sides of the sheet portion at the first or left end thereof, and at the second or right end a pair of ledges 12 facing one another and also downwardly protruding from opposite sides of the sheet portion. The band-shaped sheet portion 10 is reinforced with longitudinal ridges 10*b* which protrude downwardly to extend along opposite sides of said portion.

The ornamental cover 2 is a molded plastics article of a given shape, and is fixed to the upper surface of the base plate 1, by using punched holes 10*c* located at longitudinal end regions thereof.

The distance between the ledges 11 becomes slightly larger toward their lower ends. An L-shaped hooking arm 13 protrudes inwardly from the inner edge of each ledge 11 so as to face the center of the base plate. Each of the hooking arms 13 has a vertical leg 13*b*, and these legs always overlap with one another at least partially. As illustrated at the extreme left in FIG. 1. The hooking arms 13 are usually caused by the ledges 11 to open toward their lower ends. Those lower ends of the arms 13 are rounded, with their outer edges being shaped to serve as hooks 13*a*.

A clampable member 13*c* is formed integral with an outer and upper base portion of each vertical leg 13*b*, and protrudes outwardly therefrom so as to provide the vertical leg with a contactable extension which constitutes a releasing means detailed below. The lower edges of the clampable members 13*c* are arcuate.

At the right end of FIG. 1 and relative to the sheet portion 10, a pivot receiving aperture 12*a* is formed through a lower portion of each bracket 12, which portion has also a shoulder 12*b* formed to face the center of the base plate.

Spring Board

The spring board 3 is a relatively narrow elongated band made of spring steel, and has an intermediate region bent downward between its ends.

As shown in FIG. 2, each end of the spring board 3 has an elongated U-shape providing generally horizontal legs 3*a*. The legs have at their opposite outer sides stopping shoulders 3*b* spaced from the longitudinal ends. One of the longitudinal ends having the horizontal legs 3*a* of the spring board 3 is disposed between the brackets 12, as shown in FIG. 1. The other or left end which also has the horizontal legs 3*a* is thereby set in place between the ledges 11. Thus, the stopping shoulders 3*b* at one end engage the brackets 12 and the outer shoulders 3*b* at the other end engage the ledges 11. Therefore, each of the longitudinal edges of the spring board 3 is restrained so as not to slide longitudinally beyond a limited distance, and thereby is capable of allowing this board to elastically flex toward the base plate 1. It may suffice that alternatively only one of the longitudinal ends of the spring board 3 can slide on the base plate 1 to enable such a flexing.

The spring board 3 includes, as a restoring member, a tongue 14—as seen in the left central portion of the spring board in FIG. 2. The tongue 14 is made of spring steel and has one end (the right as shown) integral with a junction 3c which unites the base regions of horizontal legs 3a and 3a. The outer or left end portion of the tongue 14 is interposed between the legs 3a and is bent downwardly to be substantially L-shaped in side elevation.

Extending outward from and integral with the lower extremity of tongue 14 is an annular frame 15, which is provide as a shackling member in the releasing means. The annular frame 15 extends generally in parallel with the base plate 1, and has a central rectangular opening 15a of such a size as to allow insertion of the lower portions of the hooking arms 13.

Figure 3:
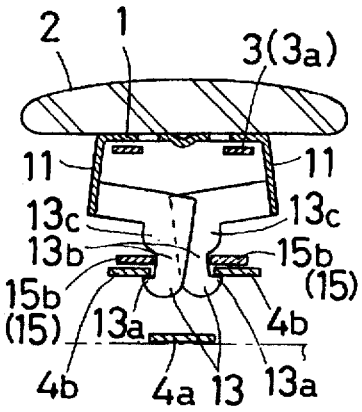
FIG. 3 is a cross section taken along the line 3—3 in FIG. 1.

FIG. 3 shows the hooking arms 13 inserted in the opening of the annular frame 15. This opening is that designated 15a in FIG. 2. In the FIG. 3 state, a pair of restrainers 15b which are formed as the opposite lateral sides of the annular frame 15 are disposed between the hook 13a and each clampable member 13c, i.e., the contactable extension. An outer end of the annular frame 15 is bent upward toward the base plate so as to form a stopper 15c, as seen in FIGS. 1 and 2.

Hair Retainer

As readily seen in FIG. 2, the hair retainer 4 is a band-shaped spring steel, and its middle region intermediate the longitudinal ends is slightly curved upwards.

The hair retainer 4 has a left-hand end formed with two parallel slits extending longitudinally of the retainer. A middle portion between the slits is a downwardly dented part 4a, which is interposed between two parallel and outer arched bridges 4b, which in turn are curved upwards to serve as an engaging part. A right-hand end 4c of the hair retainer is bent upwardly and outwardly, and small pivots 4d protrude from the lateral sides of the right-hand end. A row of three slots 4e, which extends longitudinally of the hair retainer, are provided in the intermediate region thereof.

The right-hand end 4c of the retainer is positioned between the brackets 12 as shown in FIG. 1. The pivots 4d at the end 4c are respectively inserted in the apertures 12a so that the hair retainer 4 is rotatably mounted on the base plate 1. Such a hinged connection permits the hair retainer 4 to swing freely toward its closed position, until the shoulders 12b of the brackets 12 collide with stopping lugs 4f protruding sideways from the opposite sides of the right-hand end 4c. Thus, an interim stable state appears in which a given distance is kept between the engaging part 4b and the hooking arms 13 of the base plate 1. However, the hair retainer cannot easily swing any further out of this interim state.

As described above, the hair retainer 4 in the hair clip of the invention will be opened and closed around its right-hand end 4c acting as a fulcrum so that hair of a user is releasably clipped between the spring board 3 and the retainer 4.

Operation

In detail, the hair clip will be closed on the hair and released therefrom in the following manner.

Clamping

When the hair retainer 4 is swung toward its closed position, its middle portion will come into contact with the spring board 3 and at the same time the stopping lugs 4f will bear against the shoulders 12b of the brackets 12.

Since both the spring board 3 and the retainer 4 are elastic, the movable end of this retainer can be pressed further toward the spring board 3. The hair retainer 4 will flex itself until its arched bridges 4b as the engaging part collide with the lower end of the hooking arms 13.

With the movable end of the hair retainer 4 being further pressed, the inner edges of the arched bridges 4b as the engaging part of this retainer will contact the round lower ends of the vertical legs 13b and subsequently be guided toward the upper base ends of those legs, which will therefore be forced to more completely overlap each other.

When the arched bridges 4b pass the hooks 13a, the hooking arms 13 will spring open due to the resilient force which has been imparted thereto, whereby the bridges 4b as the engaging part are latched by the hooks 13a.

In this latched state (as shown in FIG. 3), the restrainers 15b and 15b are facing each other and are located outside the hooking arms 13 and fit thereon between the upper clampable extensions 13c and the lower hooks 13a.

Unclamping

The releasing of the latched engaging part will be effected by causing the vertical legs 13b of the hooking arms 13 to more completely overlap each other. Details of such an unlatching operation in this embodiment are as follows.

At first, the movable end of the hair retainer 4 will be moved toward the base plate 1. In consequence of this motion, the arched bridges 4b (as the engaging part) come into engagement with the restrainers 15b of the annular frame 15, and immediately the inner edges of those restrainers 15b are forced into contact with the lower arcuate edges of clampable extensions 13c of the hooking arms 13. Thus, the arched bridges 4b indirectly engage the extensions 13c, with the restrainers 15b intervening between them. However, the contacting relationship between the bridges 4b and extensions also may be direct as will be brought out later.

Figure 4A:
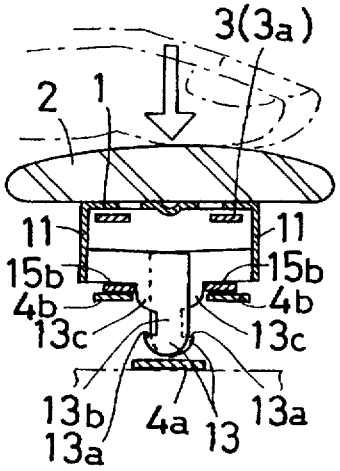
FIGS. 4A to 4C are cross-sectional views which correspond to FIG. 3 and illustrate the process of releasing the hair retainer.

As the hair retainer further advances toward the base plate, the restrainers 15b will be caused to slide upwards along the clampable members 13c. As a result the vertical legs 13b of the hooking arms 13 will fully overlap each other, as shown in FIG. 4A. In this unlatched state of the arched bridges 4b, the hooks 13a are spaced apart therefrom, and the stopper 15c which has been brought into contact with the base plate 1 will prevent the hair retainer from being displaced any longer toward the base plate 1.

It will be noted that during the unlatching operation mentioned above neither the arched bridges 4b as the engaging part nor the restrainers 15b are brought into frictional contact with the hooks 13a. Therefore, the hooks 13a are protected from an early abrasion which would cause an imperfect latching of the bridges. Since the arched bridges 4b merely indirectly engage the sideways extensions 13c as the clampable members, the bridges also are protected from partial abrasion which would similarly cause the imperfect latching.

Upon removal of the pressure which has been imparted to the movable end of the hair retainer 4, the stress stored in the spring board 3 and the hair retainer will instantaneously repel the latter away from the base plate 1, rotating it toward its open position. The arched bridges 4b will thus be displaced downwardly past the hooks 13a.

Figure 4B:
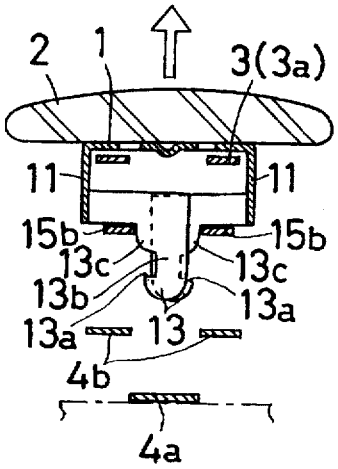
Figure 5A:
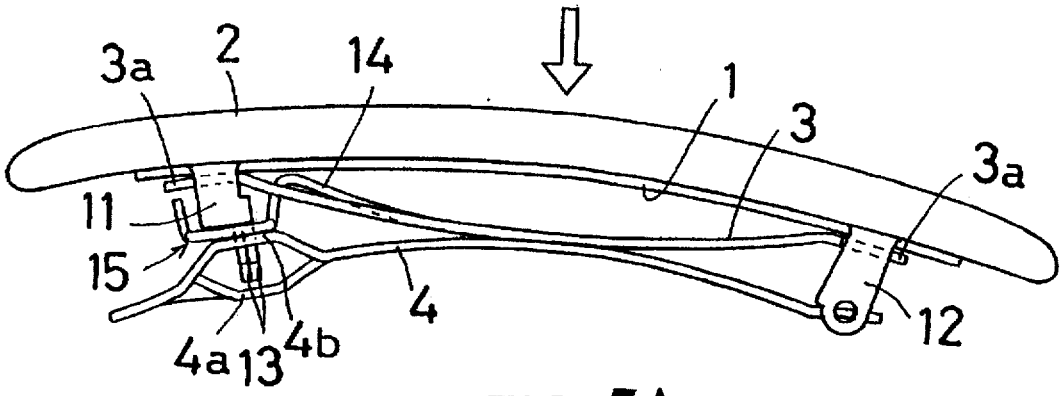
FIGS. 5A to 5C are side elevations which correspond to FIG. 1 and similarly illustrate the releasing process.
Figure 5B:
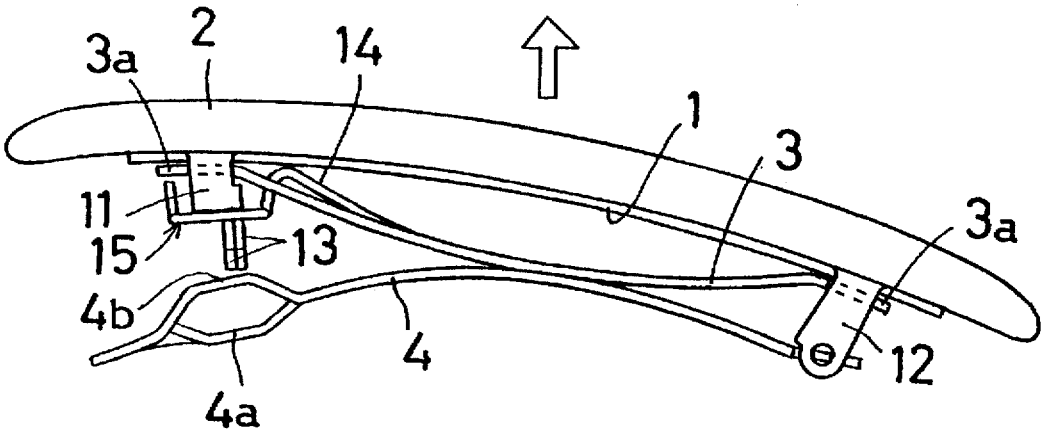

In this state shown in FIGS. 4B and 5B, the restrainers 15b of the annular frame 15 are still on the clampable members 13c of the hooking arms 13, due to a frictional resistance. Thus, the restrainers 15b can be considered to be temporarily held by the clampable members 13c which also can be considered to be holding means.

Figure 4C:
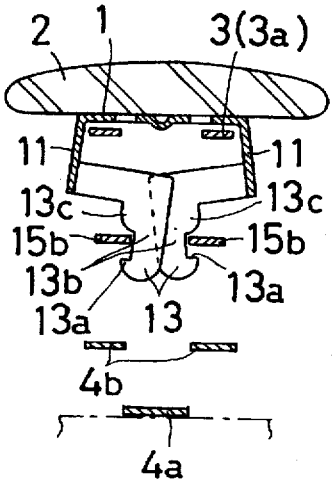
Figure 5C:
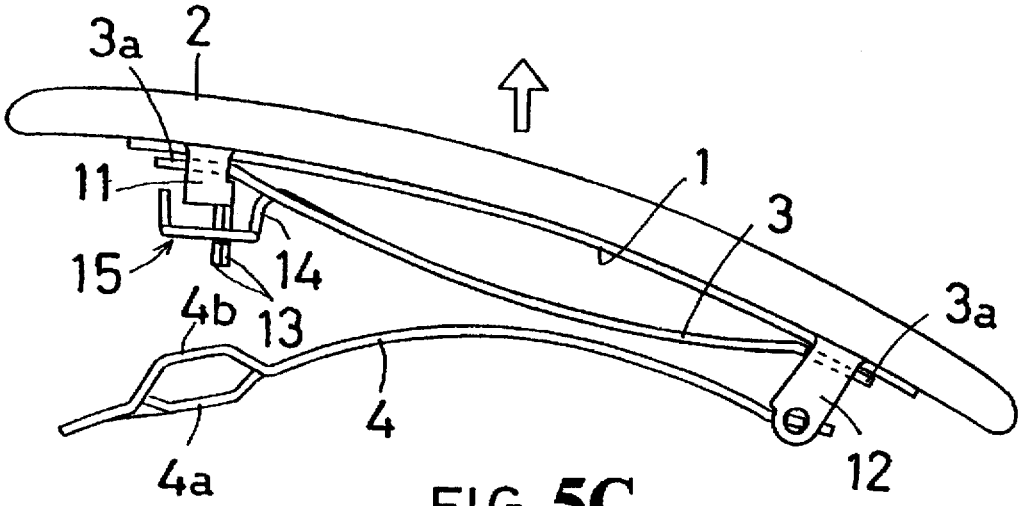

Finally, the hair retainer 4 will further rotate toward its open position, into a state shown in FIGS. 4C and 5C wherein the hair retainer is almost free, or entirely free as shown in FIG. 5C, from the spring board 3. Thus, the spring board 3 returns to its downwardly curved position, thereby urging downwardly the elastic tongue 14 integral with the spring board 3. The tongue will in turn urge the restrainers 15*b* toward the hooks 13*a* along the hooking arms 13, so that the restrainers come back to their position between the clampable members 13*c* and the hooks 13*a*, whereby the hooking arms 13 take their home position and their vertical legs 13*b* are opened outwards.

It will be understood that the hair clip of the present invention can be operated also in the same manner as the prior art hair clips. In other words, the ledges 11 and 11 may be gripped with fingers toward each other in order to cause the vertical legs 13*b* of the hooking arms 13 to overlap each other, to thereby disengage the hooks 13*a* from the arched bridges 4*b* as the engaging part. It also may be possible to provide each leg 11 with a tab or the like (not shown) to facilitate the unlatching operation.

As already detailed above, the releasing means for disengaging the arched bridges 4*b* of the retainer 4 from the hooking arms of the base plate 1 includes the clampable members which are extensions 13*c* each protruding sideways from the base portion of the arm 13, the annular frame 15 as the shackling member for restraining the arms 13 which fit in this member, and the resilient tongue 14 as the restoring member which connects the annular frame 15 to the spring board 3.

In summary, the hair clip provided herein can easily be detached from the hair of a user just by pressing with her or his hand the end of ornamental cover against her or his head, and by removing the pressure from the cover. Therefore, the user need no longer put her or his fingers uneasily in behind the ornamental cover, when releasing this hair clip. Even if the ornamental cover is so large that the outer edge thereof is considerably remote from the movable end of the retainer, the releasing operation can be done without any difficulty.

The readily releasable hair clip of the invention can be designed by making just a slight change in the design of the existing types of hair clip. The hair clip provided herein is simpler in structure and easier to manufacture and assembly, and thus production cost will be markedly reduced.

Such a releasing means may be modified in the present invention. For example, the arched bridges 4*b* as the engaging part of the hair retainer 4 may be designed to directly contact the extensions 13*c* of the arms 13. So the contacting relationship between the clampable members 13*c* and the engaging part 4*b* may be either direct or indirect. In addition, the annular frame 15 may be replaced with a U-shaped piece as the restraining members, wherein this piece may be connected to the hair retainer 4 so as to engage with and hold in place a pair of protrusions jutting from lower ends of arms 13 when they overlap each other. The spring board 3 may be attached to the base plate 1 as is the case in the above-described first embodiment, but alternatively be fixed to the hair retainer 4. The incorporation of these features into the invention can be appreciated from the ensuing description of second and third embodiments of the invention.

Second Embodiment

For ease of understanding, features in this embodiment which are the same or analogous to those of the first embodiment are designated by the same numeral but increased by 100. Thus, in FIG. 6, the base plate is designated 101, the ornamental cover 102, the spring board 103 and the hair retainer 104.

Figure 6:
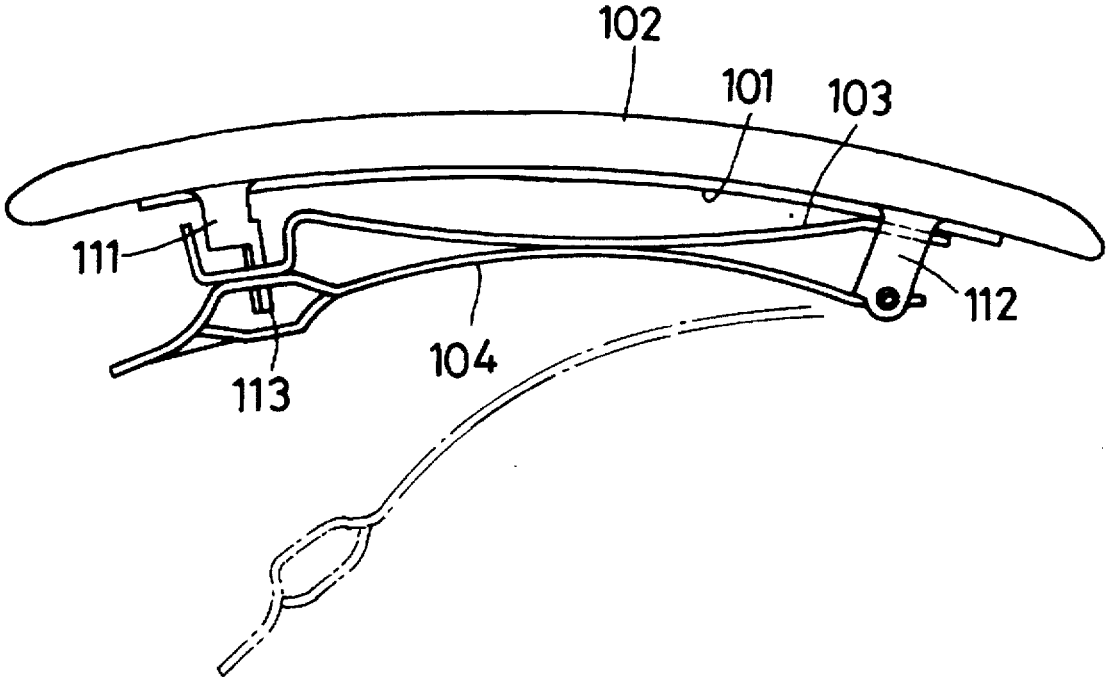
FIG. 6 is a view similar to FIG. 1 but showing a second embodiment of the invention.

Again, there are ledges—see the left side of FIG. 6—but now designated 111. The ledges at the right side are designated 112.

Figure 7:
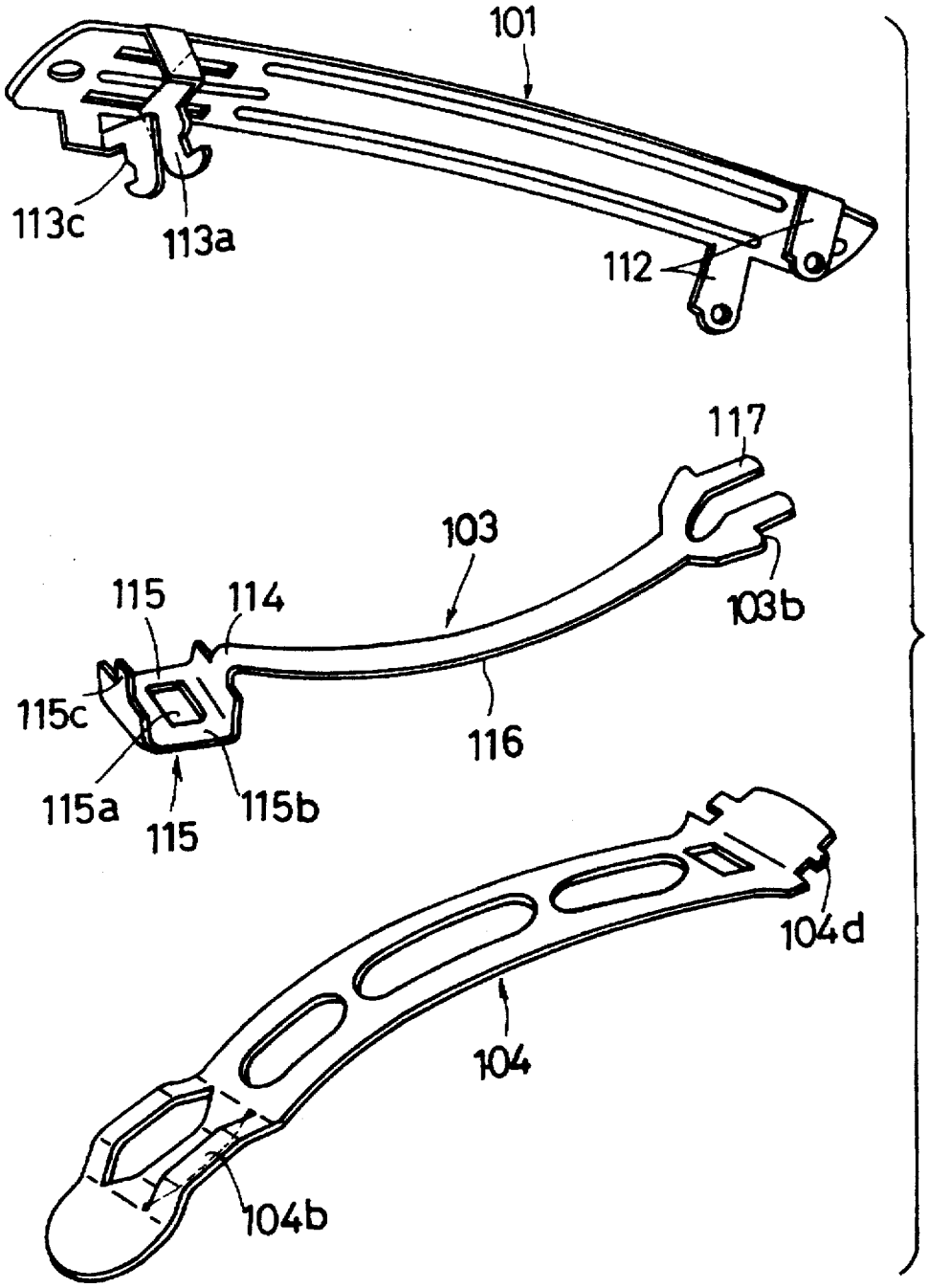
FIG. 7 is an exploded perspective view, similar to FIG. 2 but of the second embodiment as shown in FIG. 6.

The retainer 104 is pivotally supported at its right hand end on the brackets 112—as by pivots 104*d*—see FIG. 7. The ledges 111 at the left hand end carry the L-shaped hooking arms 113 which are best seen in FIG. 7 where they are seen in partial overlapping condition. In all respects, the base plate 101 of this second embodiment is identical to the base plate 1 of the already-described first embodiment. Also, the hair retainer 104 of this second embodiment is identical to the hair retainer 4 of the first embodiment.

The identity of these two members in the first and second embodiments can be readily appreciated from a consideration of FIGS. 2 and 7. A comparison of these views reveals that the spring board 103 is different in this second embodiment from the spring board 3 of the first embodiment. The right hand end is the same in having stopping shoulders 103*b*. This right hand end has a U-shape as before except that there are no elongated legs 3*a* and no apertures—as are interrupted by the junction 3*c* of FIG. 2.

Rather, the spring board 103 has a narrower mid-section—as at 116—terminating in legs 117 at the right hand end and a restoring member at the left end. This restoring member includes an annular frame which again provides a shackling means in the releasing means.

The shacking means or member has a central opening which is defined in part by restrainers 115*b*—again similar to that provided at the left end of the first embodiment—see particularly FIG. 2. Again, there is provided an integral part called a stopper which is designated 115*c*.

In other words, the curved end 114 of the mid-portion 116 now provides the tongue 14 of the first embodiment and the left end legs 3*a* of the first embodiment have been eliminated.

Operation of Second Embodiment

Figure 8:
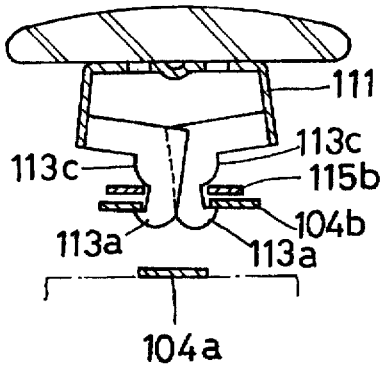
FIG. 8 is a cross sectional view similar to FIG. 3 but of the second embodiment.

A comparison of FIG. 8 with FIG. 3 reveals that the operation is generally the same, the essential difference being that the second embodiment as seen in FIG. 8 does not have the spaced apart legs 3 (3*a*). Thus, starting from the bottom, the embodiment of FIG. 8 has a downwardly dented part 104*a* which is positioned below the hooks 113*a*. Again, positioned between the hooks 113*a* and the projections or clamping members 113*c* are the restrainers 115*b* and the arched bridges 104*b*.

Figure 9A:
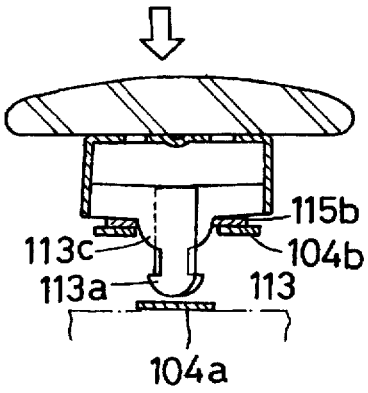
Figure 9B:
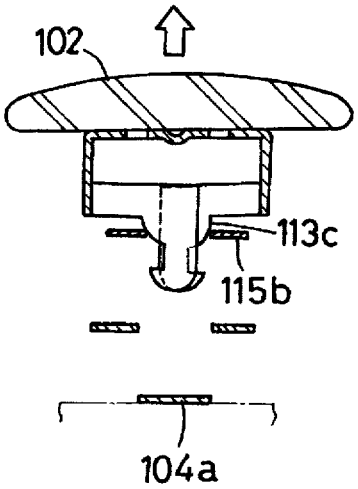
Figure 9C:
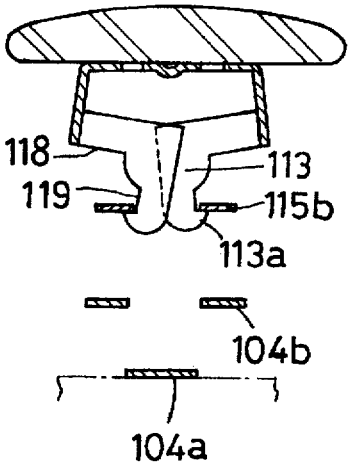

Further, the description of the operation relative to FIG. 4A applies to that illustrated in FIG. 9C where the restrainers 115*b* have been urged upwardly by the arched bridges 104*b*—and simultaneously outwardly by the projections or clampable members 113*c*. This again can be appreciated by the fact that the downwardly dented part 104*a* has moved upwardly to close to being engagement with the hooks 113*a* of the hooking arms 113.

In like fashion, the showing in FIG. 9B corresponds to that of FIG. 4B—except for the omission of the elements 3, (3*a*). In similar fashion, the above description relative to 3*b* also applies to the operation depicted in FIG. 9B.

The restrainers 115*b* are shown slightly lower in FIG. 9B than are the restrainers 15*b* in FIG. 4B. This difference stems from the fact that the shackling member is arranged at a different angle in the two embodiments in this state of operation—compare FIGS. 5B and 10B. And this angular difference stems from the fact that the shackling member in the second embodiment is an extension of the spring board 103 itself and not of the tongue 14 and thus is capable of storing additional potential energy when stressed as in going form the showing in FIG. 6 to that of FIG. 10A. In FIG. 6, there is no stress on the shackling member while there is in the condition illustrated in FIG. 10A—due to the fact that the stopper 115*c* now contacts the underside of the base plate 101 and swerves as a fulcrum to cause the U-shaped shackling member to flex and store energy. This stored energy provides more effective release of the restrainer surfaces 115*b* from their frictional engagement with the clampable members 113*c*.

Again, the showing in FIG. 9C is comparable to that of FIG. 4C but with the exception of not showing the members 3 (3*a*). As before, the restrainers 115*b* have now moved downwardly into contact with the hooks 113*a* and the arched bridges 104*b* are spaced between the hooking legs 113 and the downwardly dented portion 104*a*.

Figure 10A:
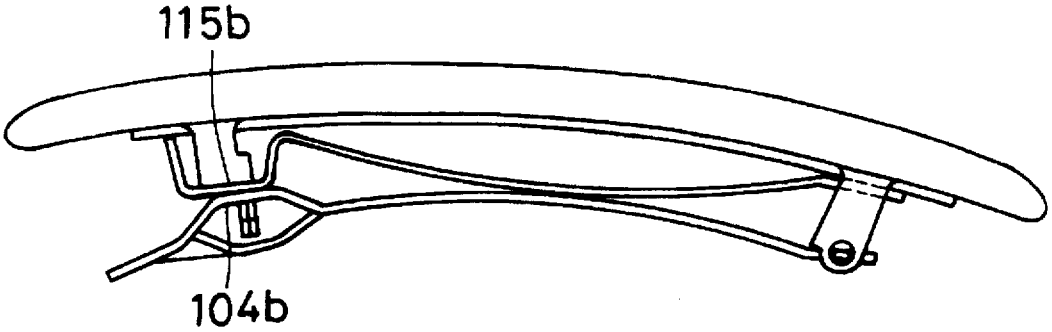
FIGS. 10A to 10C are side elevations which correspond to FIGS. 5A to 5C but of the second embodiment.
Figure 10B:
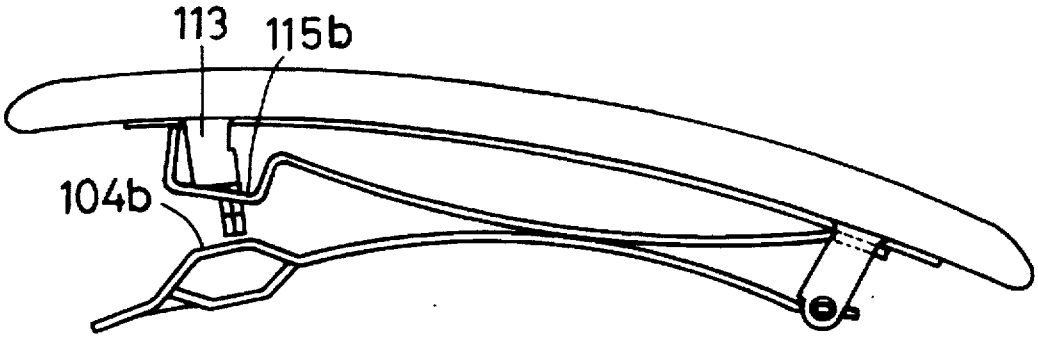
Figure 10C:
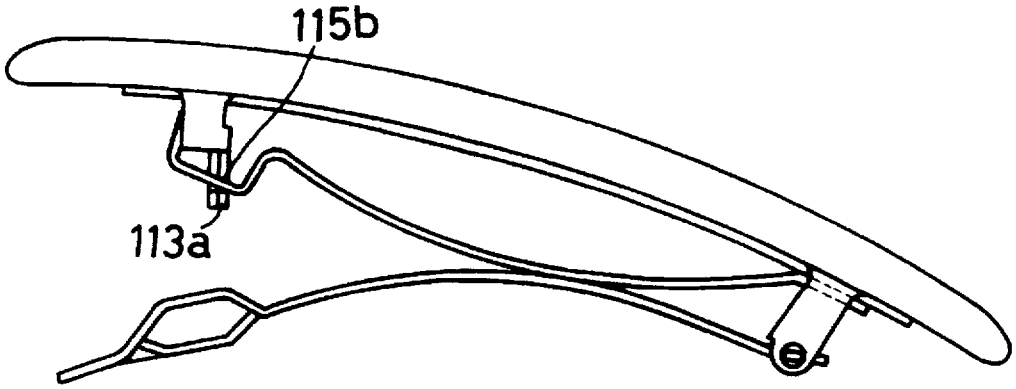

FIGS. 10A–10C are analogous to FIGS. 5A–5C but are directed to the second embodiment. FIG. 10A shows the members of the invention in the condition illustrated in FIG. 9A. Thus, the restrainers 115*b* are contacted by the arched bridges 104*b* and the restrainers 115*b* have been moved upwardly into engagement with the clampable members 113*c*.

The showing in FIG. 10B corresponds to that of FIG. 9B wherein there is now a separation between the restrainers 115*b* and the arched bridges 104*b*. It will be noted that the restrainers 115*b* at the left end are still in contact with the clampable members 113*c*—see the tag line from the numeral 113*c* to the hooking arms generally designated 113.

Then in FIG. 10C the members of the hair clip are shown in the condition illustrated in FIG. 9C and it will be noted that the restrainers 115*b* now are in contact with the hooks 113*a*.

Third Embodiment

This embodiment is shown in conjunction with FIGS. 11–14 which correspond generally to FIGS. 1–4 and 6–10. The same or similar element in the third embodiment has similar numerals except that they are increased by 200 over those in the first embodiment. Thus, referring to FIG. 12, the numeral 201 designates the base plate, the numeral 203 designates the spring board and the numeral 204 the hair retainer and in FIG. 11, the numeral 202 designates the ornamental cover.

Figure 12:
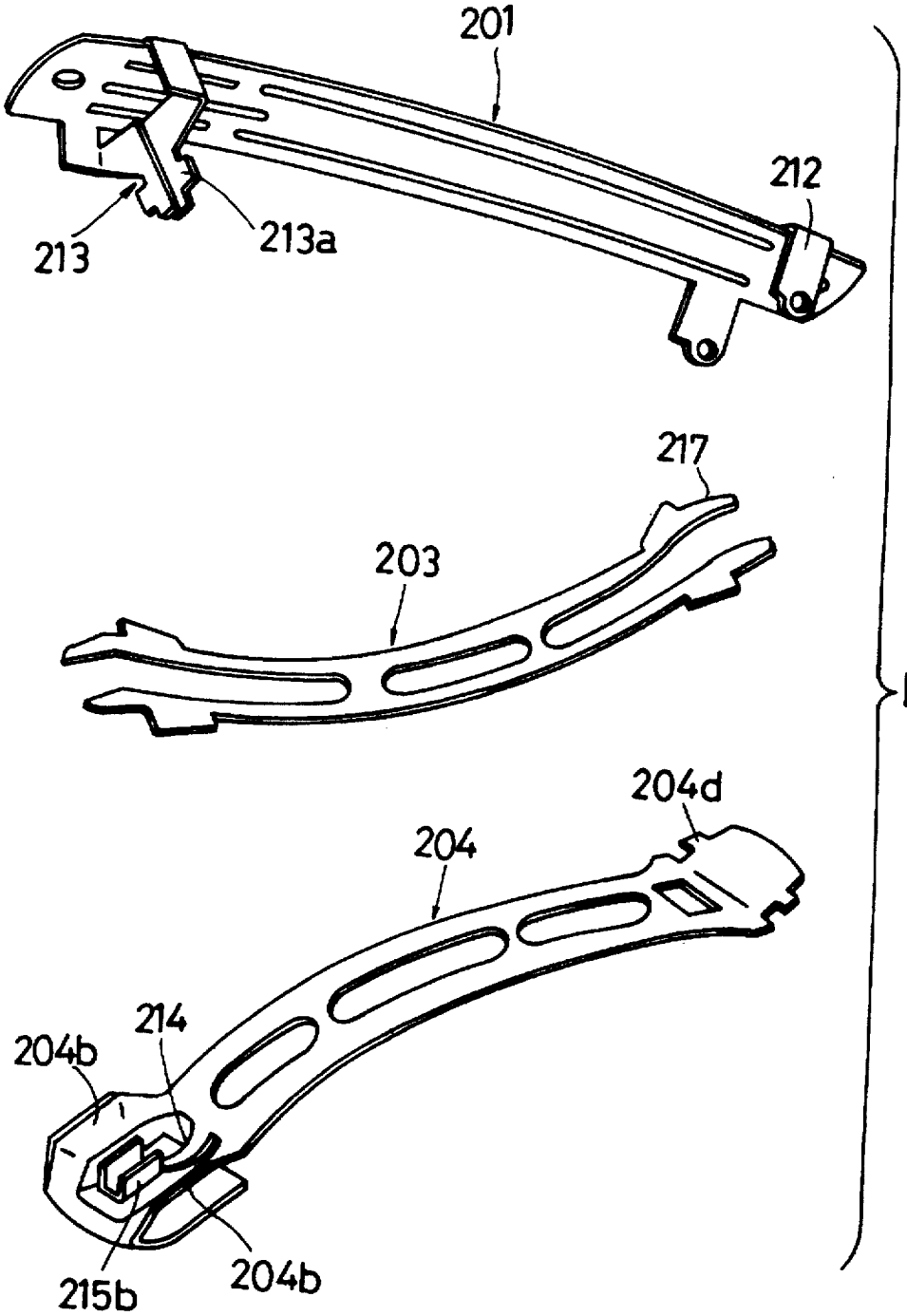
FIG. 12 is an exploded perspective view, similar to FIG. 2 but of the third embodiment as shown in FIG. 11.

In the third embodiment, as most quickly appreciated from a consideration of FIG. 12, there are differences in all three of the functional members 201, 203 and 204 from those seen in FIG. 7 at 101, 103 and 104 and FIG. 2 at 1, 3 and 4.

Briefly, the base plate 201 differs from the base plate 1 of the first embodiment and the base plate 101 of the second embodiment, in the shape of the hooking arms 213.

Briefly, the spring board 203 differs from the spring board 3 of the first embodiment in not having the tongue 14. The showing in FIG. 12 differs from that of FIG. 7 in not having eliminated the openings in the mid-section 116 nor does it have the shackling member. In general, the spring board 203 is generally symmetrical about a mid-plane somewhat like the spring board of my earlier U.S. Pat. No. 4,919,155.

The hair restrainer 204 differs from both the prior embodiments in the left end portion. The left end now incorporates structure performing the functions of both the arched bridges 4*b*, 104*b* and the restrainers 15*b* and 115*b*. The engaging portion function of the arched bridges is performed by the wings 204*b* provided at the left end of the hair retainer 204. As can be appreciated from a comparison of FIGS. 13 and 14, upon downward movement by pressure on the ornamental cover 202, the wings 204*b* engage clampable members 213*c* and bring the hooking legs generally designated 213 into overlapping relationship at their lower or bottom ends. The shape of the clampable members or projections 213*c* is generally like that of the clampable members 13*c*, 113*c* except that instead of being partially arcuate, the undersides are linear or straight as indicated at 218 in FIG. 14C. However, in all three embodiments, the contour of the clampable members provides a wedging action to drive the legs 13, 113, 213 into overlapping relation.

The function of the restrainers 115*b* of the second embodiment as seen in FIG. 7 and of the restrainers 15*b* of the first embodiment as seen in FIG. 2 is performed by a tongue-like member generally designated 214 in FIG. 12. This terminates in restraining members 215*b* as seen in section in FIGS. 13 and 14. This portion 215*b* corresponds to the restraining means of the previous embodiments and when the wings 204*b* press against the wedging contours 218 of the undersides of the clampable members 213*c*, the lower ends of the hooking legs 213 move into overlapping relation and the resilient tongue-like member 214 has its restrainer portion 215*b* move upwardly to hold the legs 213 in the condition illustrated in FIG. 14A.

Figure 14A:
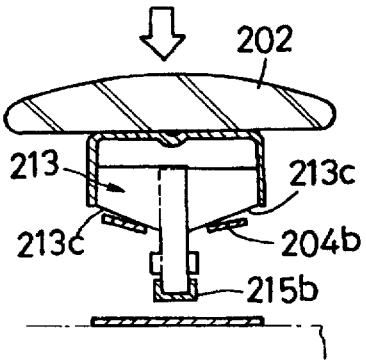
FIGS. 14A to 14C are cross-sectional views which correspond to FIGS. 4A to 4C but of the third embodiment.
Figure 14B:
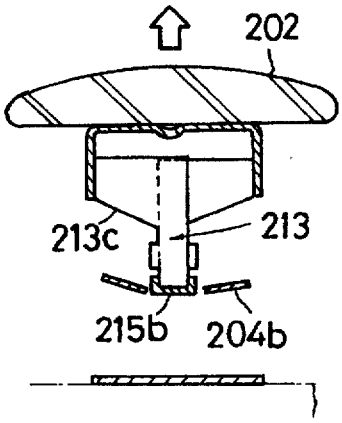

In FIG. 14B, downward pressure against the ornamental cover 202 has been released with the wings 204*b* now moving downwardly but with the restrainer portion 215*b* still being frictionally engaged with the overlapping hooking arms 213.

Figure 11:
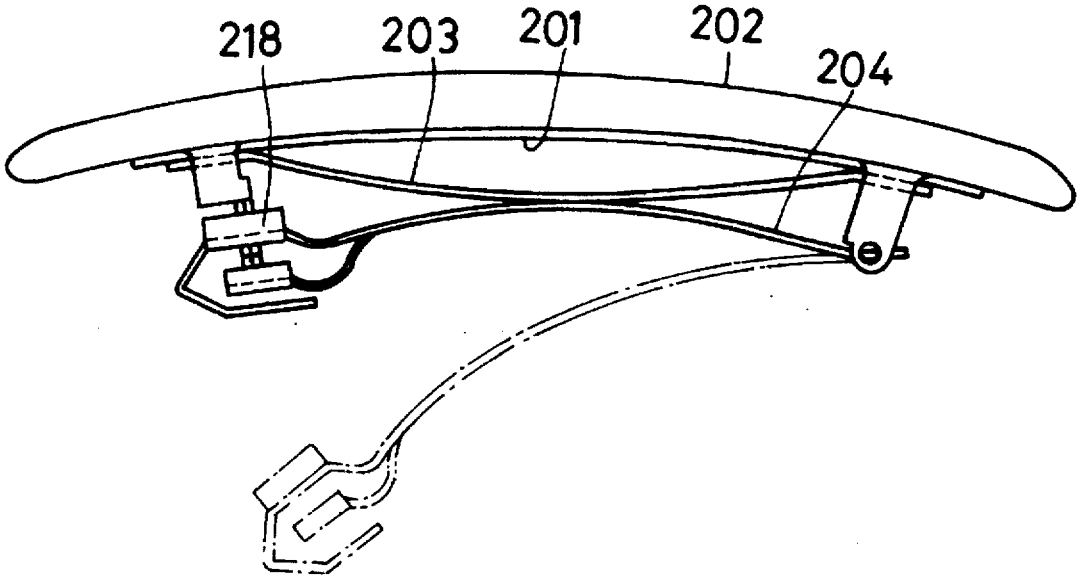
FIG. 11 is a view similar to FIG. 1 but showing a third embodiment of the invention.
Figure 14C:
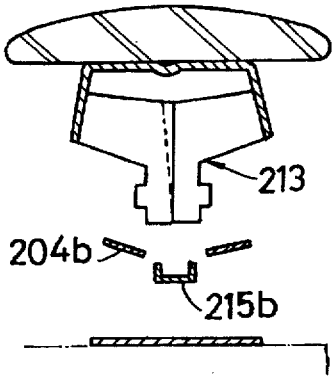

Further downward movement of the hair retainer 204—see the dotted line showing in FIG. 11—results in the showing of FIG. 14C where now the tongue-like member 214 providing the restraining means 215*b* has moved downwardly (see also FIG. 11) so as to unclamp the previously overlapping hooking arms 213 whereupon the clasped hair can be removed.

Summary of Structure

In all three embodiments there is provided a base plate 1, 101, 201. In each embodiment there is provided an ornamental cover 2, 102, 202. In each embodiment, there is provided a spring board 3, 103, 203. Further, in each embodiment there is provided a hair retainer 4, 104, 204. In each embodiment there is provided a pair of hooking arms 13, 113, 213. These are capable of overlapping each other as can be appreciated from a consideration of FIGS. 4A, 9A and 14A.

Each hooking arm has a base portion adjacent the base plate which constitutes a clampable member 13*c*, 113*c*, 213*c*. Spaced from this clampable member on each hooking arm is a hook as at 13*a* in FIG. 2, 113a in FIG. 7 and 213*a* in FIG. 12. The spacing is exemplified in FIG. 9C by the numeral 119.

The hair retainer in each embodiment has pivots 4*d* in FIG. 2, 104*d* in FIG. 7 and 204*d* in FIG. 12 which rotatably connect the hair retainer to the right hand end of the base plate ledges 12, 112, 212—see FIGS. 2, 7 and 12, respectively.

At its left hand end, the hair retainer has an engaging part which is adapted to be releasably latched by the pair of hooking arms. In the first embodiment of FIGS. 1–5, the engaging part are the upwardly arched bridges 4*b* and in the second embodiment the same structure as at 104b (compare FIGS. 2 and 7). The latching condition is further illustrated in FIG. 3 relative to the first embodiment and FIG. 8 relative to the second embodiment. In the third embodiment the engaging part include the wings 204b which can be seen to be latched by the hooks 213a in FIG. 13.

The invention in each embodiment has the spring board interposed between the base plate and the hair retainer and is mounted on one of the base plate and the hair retainer. More particularly, in each embodiment, the mounting is provided by the right hand end of the spring board as at the arms 3a in the first embodiment as seen in FIG. 2, the arms 117 of the second embodiment as seen in FIG. 7 and the arms 217 in the third embodiment as seen in FIG. 12. In each case, the spring board is confined between the base plate and hair retainer and thus could be considered to be mounted on either one. The spring board is shaped, i.e., bowed downwardly in each embodiment so as to urge the hair retainer 4, 104, 204 toward its open state (see FIGS. 1, 6 and 11, respectively)—as long as the engaging part 4b, 104b, 204b is latched by the pair of hooking arms 13, 113 and 213.

Each embodiment includes a releasing means for releasing the hair retainer from the base plate. In each case, the releasing means includes the clampable members as at 13c, 113c and 213c which protrude outwardly from each hooking arm base portion so as to come into a contacting relationship with the engaging part as illustrated in FIGS. 4A, 9A and 14A. In both FIGS. 4A and 9A, engaging parts 4b, 104b function through the restraining members 15b, 115b so as to contact the clampable members 13c, 113c. However, in the third embodiment as illustrated in FIG. 14A, the engaging part made up of the wings 204b contact the clampable members 213c directly.

Further, the clampable members 13c, 113c and 213c are shaped such that when the left end of the base plate is pressed toward the left end of the hair retainer (which is in its latched position the hooking arms 13, 113 and 213 are caused to overlap each other at the lower ends thereof so as to take a releasing position—see FIGS. 4A, 9A and 14A. When this occurs, there is a shackling member operably associated with the hair retainer and/or the spring board and is shaped to hold the hooking arms in their overlapping state even after they have taken the releasing position—this being illustrated in FIG. 4B, 9B and 14B relative to the respective embodiments. The shackling member in the first and second embodiments includes the restrainers 15b, 115b each of which is provided on the spring board 3, 103, respectively. However, in the third embodiment, the shackling member is provided on the hair retainer as at 215b in FIG. 14B.

Also provided in each embodiment is a restoring member which is operably associated with the hair retainer and/or the spring board and shaped to urge the shackling member toward its free position for releasing the hooking arms as the hair retainer is rotated away from the base plate toward its open state in which the engaging part is no longer latched by the hooking arms. This function is provided by the tongue 14 as part of the spring board 3 in the first embodiment. This occurs when the hair retainer 4 is further rotated toward its open position (see FIG. 4C) and wherein the hair retainer 4 is almost free from the spring board 3. The spring board 3 in returning to its downwardly curved position urges downwardly the resilient tongue 14 which is integral with the spring board 3. The tongue, in turn, urges the restrainers 15b toward the hooks 13a so that the restrainers come back to their positions between the clampable members 13c and the hooks 13a. In the second embodiment, the function of the tongue 14 of the first embodiment is incorporated into the spring board 103. So, as the spring board 103 causes a restoring to take place in the tongue 14 of the first embodiment, so also does the spring board 103 via the tongue 114 cause this to occur in the left end thereof—so as to unlatch the engaging part consisting of the upwardly arched bridges 104b.

In similar fashion in the third embodiment, the spring board 203 again urges the tongue-like member 214 via the retainer 204 to its open position. So, in effect, the tongue 214 of the third embodiment is analogous in structure and function to the tongue 14 of the first embodiment and the tongue 114 of the second embodiment which connects the spring board 103 to the shackling member 115.

Summary of Operation

Figure 13:
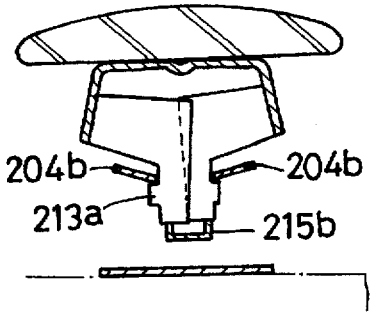
FIG. 13 is a cross sectional view similar to FIG. 3 but of the third embodiment.

Starting with the condition of FIGS. 3, 8 and 13 where the L-shaped hooking arms 13, 113, 213 are only partly overlapped, downward pressure on the ornamental cover 2, 102, 202 causes movement together of the hooks 13a, 113a, 213a and the engaging portions 4b, 104b, 204b—see FIGS. 4A, 9A and 14A. This results in a wedging action developed by the wedging surfaces or ramps as at 218 in FIG. 14C and 118 in FIG. 9C of the respective clampable members or means.

When the arms 13, 113, 213 are overlapped as in FIGS. 4A, 9A and 14A, the engaging portions move downwardly as in FIGS. 4B, 9B and 14B. However, the restraining means 15b, 115b and 215b remain temporarily in place due to frictional engagement. As the retainer 4, 104, 204 moves further downwardly—see FIGS. 4C, 9C and 14C, friction is overcome and the restrainers 15b, 115b and 215b also move downwardly to permit the arms to move apart, i.e., have less overlap.

Then, when the hair clip is again put to use, the engaging portions 4b, 104b and 204b move into the space 19, 119, 219 between the clampable members 13c, 113, 213c an the hooks 13a, 113, 213a to clamp the retainer 4,104,204 to the base plate 1, 101, 201 as in FIGS. 3, 8 and 13.

I claim:

1. A hair clip comprising:

a relatively elongated base plate having first and second ends, a pair of hooking arms on said base plate first end capable of overlapping each other, each hooking arm having a base portion adjacent said base plate, a relatively elongated hair retainer having first and second ends, said hair retainer second end being rotatably connected to said base plate second end, said hair retainer further having at the first end thereof an engaging part releasably latchable by said pair of hooking arms, a relatively elongated spring board interposed between said base plate and said hair retainer and mounted on one of said base plate and said hair retainer, said spring board being shaped so as to urge the hair retainer toward its open state as long as the engaging part is latched by said pair of hooking arms, releasing means for releasing said hair retainer from said base plate, said releasing means comprising: clampable members each protruding outwardly from each said hooking arm base portion so as to come into a contacting relationship with said engaging part, said clampable members being shaped such that when said first end of said base plate is pressed toward said first end of said hair retainer when is in its latched position, said hooking arms are caused to overlap each other to take a releasing position, shackling means operably associated with said hair retainer and said spring board and shaped to hold said hooking arms in their overlapping state even after they have taken said releasing position, and restoring means operably associated with said hair retainer and said spring board and shaped to urge said shackling means toward a free position for releasing said hooking arms as said hair retainer is rotated away from said base plate toward its open state in which said engaging part is no longer latched by said hooking arms.

2. A hair clip as defined in claim 1 wherein said shackling means and clampable members are frictionally engaged at the beginning of said releasing position.

3. A hair clip as defined in claim 1 wherein each hooking arm is relatively elongated and has an upper end connected to said base plate and a free lower end, inner and outer vertically extending sides between said upper and lower ends, said inner sides being adjacent, a hook protruding from each arm outer side.

4. A hair clip as defined in claim 3 wherein the hook is located a spaced distance from its associated clampable member.

5. A hair clip as defined in claim 4 wherein the said clampable members each is formed with a wedging edge for engaging said shackling means.

6. A hair clip as defined in claim 5 wherein said shackling means includes restrainer surfaces spaced apart a distance to engage said hook sides to have said hooking arm free ends in substantially complete overlapping condition.

7. A hair clip as defined in claim 1 further comprising an ornamental cover mounted on said base plate.

8. A hair clip as defined in claim 1 wherein said shackling means includes a stopper adapted to engage said base plate incident to releasing said hair retainer and operative to develop flexing of said shackling means.

9. A hair clip comprising a relatively elongated base plate including a pair of brackets at one end and pair of ledges at the other end, a relatively elongated hair retainer rotatably connected to the brackets at one end, said hair retainer having an engaging portion at the other end and movable between hair clamping and unclamping positions, a pair of hooking arms projecting inwardly from the inside of the ledges, each hooking arm including a leg portion having a free end with said free ends being capable of overlapping, said leg portions having opposed hooks, clampable means projecting laterally from each leg portion and spaced above said hook, said clampable means not overlapping when said arm free ends overlap, a relatively elongated spring board interposed between said base plate and hair retainer and mounted on one of said base plate and said hair retainer, said spring board being operative to urge said hair retainer away from said base plate, and means operably associated with one of said spring board and said retainer for temporarily holding said free ends in overlapping condition until said engaging portion moves out of contacting relation with said clampable means and below said hooks, each clampable means being equipped with a wedging contour facing said hook, said temporarily holding means including tongue means extending longitudinally of one of said hair retainer and spring board and having a free end, and a shackling member at said free end.

10. A hair clip as defined in claim 9 wherein said shackling member is mounted on said spring board and said shackling member includes an annular frame for engaging said hooking arms for temporarily holding the same in overlapped condition.

11. A hair clip as defined in claim 9 wherein said shackling member includes a pair of restrainer surfaces for engaging said hooking arms for temporarily holding the same in overlapped condition.

12. A hair clip as defined in claim 11 in which said shackling member is mounted on said hair retainer.

13. A hair clip comprising a relatively elongated base plate including a pair of brackets at one end and pair of ledges at the other end, a relatively elongated hair retainer rotatably connected to the brackets at one end, said hair retainer having an engaging portion at the other end and movable between hair clamping and unclamping positions, a pair of hooking arms projecting inwardly from the inside of the ledges, each hooking arm including a leg portion having a free end with said free ends being capable of overlapping, said leg portions having opposed hooks, clampable means projecting laterally from each leg portion and spaced above said hook, said clampable means not overlapping when said arm free ends overlap, a relatively elongated spring board interposed between said base plate and hair retainer and mounted on one of said base plate and said hair retainer, said spring board being operative to urge said hair retainer away from said base plate, and means operably associated with one of said spring board and said retainer for temporarily holding said free ends in overlapping condition until said engaging portion moves out of contacting relation with said clampable means and below said hooks, said temporarily holding means including shackling means engageable with said clampable means, said shackling means being equipped with stopper means adapted to engage said base plate incident to releasing said hair retainer and operative to facilitate disengagement of said shackling means from said clampable means.

* * * * *